United States Patent [19]

Tsumura

[11] 4,159,928

[45] Jul. 3, 1979

[54] PROCESS FOR PRODUCTION OF ALUMINUM

[75] Inventor: Yoshishige Tsumura, Tokyo, Japan

[73] Assignee: Mitsui Aluminium Co., Ltd., Tokyo, Japan

[21] Appl. No.: 899,460

[22] Filed: Apr. 24, 1978

Related U.S. Application Data

[62] Division of Ser. No. 798,457, May 19, 1977, Pat. No. 4,108,741.

[51] Int. Cl.[2] ..... C25C 3/06; C25D 1/00

[52] U.S. Cl. ..... 204/67; 204/10

[58] Field of Search ..... 204/67, 10

[56] References Cited

U.S. PATENT DOCUMENTS

| | | | |
|---|---|---|---|
| 1,854,684 | 4/1932 | Brode et al. | 204/67 |
| 3,761,365 | 9/1973 | Haupin et al. | 204/67 |

*Primary Examiner*—Howard S. Williams

*Attorney, Agent, or Firm*—Oblon, Fisher, Spivak, McClelland & Maier

[57] ABSTRACT

Disclosed herein is a process for producing aluminum by the steps of electrolyzing an electrolytic bath composed preponderantly of aluminum chloride while using a tungsten plate or a silicon carbide plate as the anode for thereby educing aluminum on the cathode, splitting the cathodic product of electrolysis from the cathode to produce in the electrolytic cell a muddy substance composed preponderantly of aluminum, collecting the muddy substance, then melting it to produce molten aluminum and cooling the molten aluminum.

7 Claims, 2 Drawing Figures

PROCESS FOR PRODUCTION OF ALUMINUM

REFERENCE TO COPENDING APPLICATION

This is a divisional and continuation-in-part application of my copending application U.S. Ser. No. 798,457, filed May 19, 1977, now U.S. Pat. No. 4,108,741.

BACKGROUND OF THE INVENTION

This invention relates to a process for the low-temperature electrolysis in manufacturing aluminum, which produces aluminum by electrolysis of aluminum chloride.

From an industrial point of view, aluminum has been produced to date by the Hall-Heroult Process invented in 1885 which comprises melting alumina in cryolite and electrolyzing the molten alumina.

With the latest developments in electrolytic techniques, the electric power for electrolysis according to the above-mentioned process has been reduced to 14,000 KWH per ton of aluminum. Nevertheless, the efficiency of the process in terms of energy consumption for the reduction of aluminum remains at a mere 24% as 76% of energy is consumed in keeping the electrolytic bath at about 970° C.

In view of the fact that lowering the temperature of the electrolytic bath reduces the thermal energy required for keeping the bath temperature stable, Aluminum Company of America developed a process for electrolyzing an electrolytic bath composed of 50% of NaCl, 45% of LiCl and 5% of $AlCl_3$ at a temperature of 700° C. ("A Revolutionary Alcoa Process," Business Week, Jan. 20, 1973, J. D. Harper: Eng. Min. J., 174, No. 2(1973), 30). The process, however, required special and expensive materials for the electrolytic cell such as silicon nitride, etc. due to high corrosiveness of $AlCl_3$.

Studies on the electrolysis of an electrolytic bath composed preponderantly of $AlCl_3$ at low temperatures in the range of from 120° C. to 250° C. have been conducted (Plotnikow et al: Z. Electrochem., 37(1931), 83; Engelhardt: Handb. Techn. Electrochem., 3(1934), 384; Czochralski, Mikolajczyk: Wiadomosci, Inst. Metallurg., 2(1935), 31; and Midorikawa et al: Electrochem., 24(1956), 562). However, anodes of carbon or graphite, which are the materials generally used for anodes in this field, disintegrate when applied to this method of electrolysis and therefore cannot be used. Thus the result of these studies was simply an electrolytic process for aluminum refining wherein aluminum of high purity is educed on the cathode by using aluminum of ordinary grade as the anode. This process has so far failed to find utility in practical applications. Midorikawa et al developed a technique for improving the electric depositions of aluminum on the cathode plate by adding lead chloride to the electrolytic bath. However, even when their technique is carried out under the most favorable conditions, the current density used in the formation of the electrically deposited layer cannot be raised above 0.5 $A/dm^2$ and the thickness of the resulting layer is about 0.1 mm at most. If the current density is raised above 0.5 $A/dm^2$, the educed aluminum is not deposited on the cathode plate and therefore cannot be collected. Since the current density is too low and the electrically deposited layer is too thin, their technique has not been reduced to commercial application.

The object of the present invention is to provide an improvement in a process for educing aluminum on the cathode by the electrolysis of a bath composed preponderantly of aluminum chloride, which improvement is capable of industrially producing aluminum in an electrolytic bath of low temperature.

BRIEF SUMMARY OF THE INVENTION

This invention is based on two developments, one relating to the material for the anode and the other to the operational process. To be specific, this invention has succeeded in low-temperature electrolysis of an electrolytic bath composed preponderantly of aluminum chloride, which electrolysis has heretofore been regarded as industrially impossible to conduct, by using as the anode a tungsten plate or a silicon carbide plate not susceptible to disintegration in the bath and has also succeeded in industrialization of the production of aluminum by carrying out a method comprising the steps of circulating an electrolyte with a pump so that aluminum educed on the cathode is easily separated from the cathode, precipitating a muddy substance from the electrolyte, filtering and then melting the muddy substance to produce molten aluminum phase composed preponderantly of aluminum, This method accomplishes what has heretofore been regarded as impossible because the difficulty in the aforementioned electrolytic process for aluminum refining to recover aluminum from the cathode to which the educed aluminum is attached.

In order to obtain aluminum of high purity (99.99% or more) according to the present invention, it is necessary to replace the tungsten or silicon carbide anode with an aluminum anode.

The aluminum educed on the cathode grows in the shape of dendrites and, if left to continue such growth, has the possibility of forming a short-circuit between the cathode and the anode. This invention, therefore, also embraces a technique for precluding this phenomenon by having magnesium salt or calcium salt incorporated in the electrolytic bath.

Since electrolysis can be effected at low temperatures in the range of from 120° C. to 250° C., according to this invention, no special material for the electrolytic cell is required, the volatility of aluminum chloride is small, the amount of heat energy for maintaining the temperature of the electrolytic bath is also small and the electric power for electrolysis is less than 10,000 KWH per ton of aluminum. That is to say, this invention can raise the electric current efficiency to 90% and reduce the electrolytic voltage to less than 3 V. In producing refined aluminum according to the Hoopes Process, 16,000 KWH of electric power per ton of aluminum is required, whereas according to this invention if an aluminum plate is used as the cathode and the electrolytic voltage is fixed at 1 V, then the electric power required for electrolysis may be reduced to 3,311 KWH which is about one fifth of the electric power required in the conventional process.

DETAILED DESCRIPTION OF THE INVENTION

Figure 1:
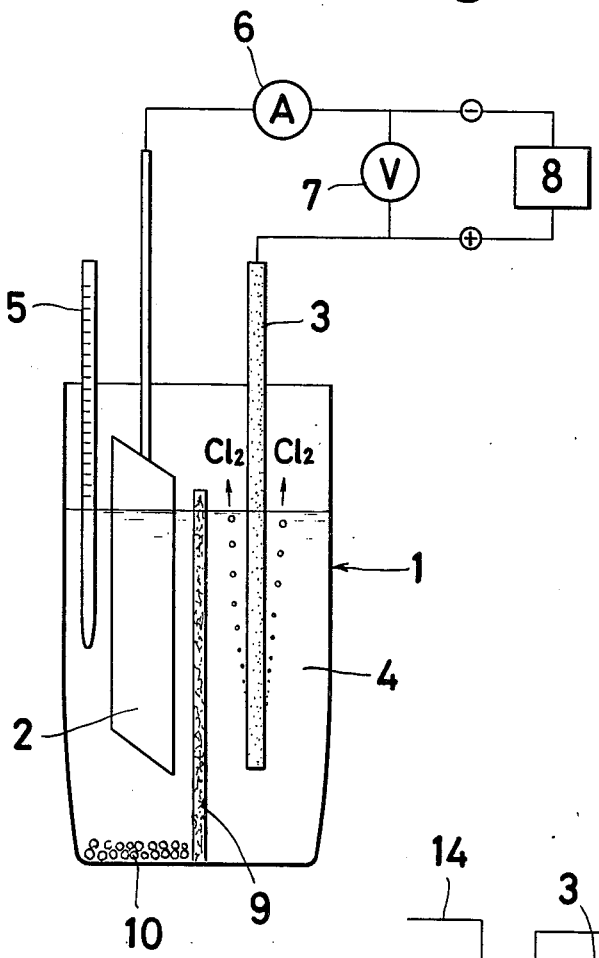
FIG. 1 is a schematic diagram illustrating an electrolytic cell used in Example 1.

This invention relates to an improvement in and concerning a process for the production of aluminum by the electrolysis of a bath composed preponderantly of aluminum chloride. To be specific, this invention produces metallic aluminum by the steps of using a tungsten plate or a silicon carbide plate as the anode in an electrolytic cell, electrolyzing at a high current density a bath composed preponderantly of aluminum chloride for thereby educing aluminum on the cathode, forcibly causing or naturally allowing the educed aluminum to be split from the cathode plate to give rise to a muddy substance composed preponderantly of aluminum in the electrolytic cell and thereafter melting the muddy substance.

This invention enables aluminum to be continuously produced at high yields without reference to the condition of the aluminum being educed on the cathode, rendering the low-temperature electrolysis of aluminum commercially feasible. The success of this method as a process for commercially producing aluminum lies in the combination of an anode which does not disintegrate in low-temperature electrolysis with an electrolytic bath of low melting point.

The anode is described hereinafter. In case where an electrolytic bath composed preponderantly of aluminum chloride is used, as in the present invention, chlorine is produced on the anode. Accordingly, carbon or graphite would seem to be a suitable material for the anode. In fact, however, when a carbon or graphite anode is used in the electrolysis of the bath, the anode disintegrates from its surface inwards. Disintegration does not occur when the concentration of aluminum chloride is low as in the Alcoa Smelting Process.

The present inventor assumes the cause of anode disintegration to be as follows.

The molten electrolyte containing aluminum chloride has high power of penetration and therefore permeates the carbon or graphite. If an electric current is applied to the anode permeated with electrolyte, then the temperature of the interior of the anode is raised to a very high level by the heat of resistance. The relationship between the vapor pressure and the temperature of aluminum chloride is as follows:

123.8° C.: 10 mmHg
161.8° C.: 200 mmHg
171.6° C.: 400 mmHg
180.2° C.: 760 mmHg

That is to say, the vapor pressure rises rapidly as the temperature increases. Since KCl and NaCl are also contained in the bath used, however, true values of the vapor pressure are lower than the above-mentioned values. This vapor pressure may possibly cause anodes made of carbon or graphite to disintegrate.

Reducing the concentration of $AlCl_3$ in the bath causes the value of the vapor pressure to become small and therefore prevents the disintegration of the anode from occurring. However, since the reduction causes the melting point of the bath to be raised, low temperature electrolysis, which is the object of this invention, cannot be effected. In view of the above, the present inventor has conducted studies on anode materials suitable for the electrolysis of a bath composed preponderantly of aluminum chloride having a low melting point and conducted the following experiment.

EXPERIMENT

Specimens 1–8 mm in diameter and 150 mm in length were prepared from various kinds of materials. An electrolytic bath composed of 76.3% by weight of $AlCl_3$, 9.2% by weight of KCl and 14.5% by weight of NaCl was used. Electrolysis was effected under the anodic current density of 10–190 A/dm$^2$ by using each of the specimens as the anode and an aluminum plate as the cathode. The results (weight decrease of the anode and electric resistance) are shown hereunder.

| Anode material | Electric resistance (Ω cm) | Weight decrease (g/Ah) |
|---|---|---|
| Tantalum (99.85% in purity) | $15.5 \times 10^{-6}$ | 0.196 |
| Platinum (99.9% in purity) | $10.5 \times 10^{-6}$ | 0.097 |
| Molybdenum (99.5% in purity) | $4.77 \times 10^{-6}$ | 0.088 |
| Tungsten (99% in purity) | $5.48 \times 10^{-6}$ | 0.000 |
| Fe-76.72% Si | 3.6 | 0.102 |
| Fe-20%Si | 1.2 | 0.681 |
| Metallic silicon (98.5% in purity) | 7.5 | 0.352 |
| Silicon carbide (70–90% in purity) | 0.05–6.0 | 0.000 |

From the results shown in the above Table, the present inventor came to the conclusion that tungsten or silicon carbide is the most suitable material for an anode to be used in the electrolysis of a bath composed preponderantly of $AlCl_3$.

Further, in order to obtain aluminum of high purity, it is necessary to use aluminum of a purity of more than 99% as the anode.

The bath for the present invention is composed preponderantly of aluminum chloride. A particularly preferable bath composition involves aluminum chloride, potassium chloride and sodium chloride. In this bath composition, the ternary eutectic composition is made up of 76.3% of aluminum chloride, 9.2% of potassium chloride and 14.5% of sodium chloride. The melting point of this bath is 93° C.

For the practical purpose of the present invention, the electrolytic bath is required to have an aluminum chloride content of from 50% to 93% by weight. If the content is lower than 50% by weight, then the melting point of the bath exceeds 200° C. If the content is higher than 93% by weight, then the aluminum chloride volatilizes vigorously and consequently the operation becomes difficult to carry out. As to the percentage composition of other components of the bath, sodium chloride is required to account for from 10% to 40% by weight and potassium chloride for from 0% to 36% by weight. The percentage composition described above is critical because, as is evident from the ternary phase diagram of aluminum chloride, sodium chloride and potassium chloride, the three components are required to fall in the specified ranges in order for the melting point of the mixed bath to fall below 200° C. Particularly, the sodium chloride content within the specified range has an effect of improving the electric conductivity of the bath. The substances which the bath is not allowed to contain are those defiling substances such as, for example, chlorides of iron, silicon and copper which have adverse effects upon the quality of aluminum metal.

For actual use, the bath compositon is suitably determined by considering all these factors. Preferably the bath composition is from 60% to 87% of aluminum chloride, from 14% to 30% of sodium chloride and from 0% to 10% of potassium chloride respectively by weight. The melting point of this bath falls in the range of from 93° C. to 160° C.

Other necessary factors for the electrolysis according to the present invention are hereinafter described.

Although the velocity of the eduction of aluminum increases in proportion to the magnitude of current density, the current density increases with increasing cell voltage and decreasing current efficiency. The current density for actual electrolysis, therefore, is chiefly chosen from the practical point of view. The lower limit of the current density for the cathode is 0.5 $A/dm^2$. If the current density is very low, then problems tend to occur with respect to the splitting off of aluminum educed and electrically deposited on the cathode and the rate of the formation of aluminum is itself lowered to the point where the process is deprived of commercial feasibility. From the economic point of view and in consideration of operational factors such as voltage efficiency, bus bar temperature and cell temperature, the upper limit of the current density is fixed at 200 $A/cm^2$.

For similar reasons, the upper and lower limits of the current density for the anode are fixed at 0.5 $A/dm^2$ and 200 $A/dm^2$ respectively and those of the cell voltage are fixed at 11.4 V and 2.7 V (on the assumption that the inter-electrode gap is 5 mm) respectively. It should be noted that the limits on the cell voltage are automatically determined in accordance with the limits on current density.

The temperature limits for the electrolytic bath corresponding to the limits on current density and cell voltage are 120° C. to 250° C.

Since the electrolysis is carried out at these low temperatures, the electrolytic cell need not be made of a special anticorrosive material. A cell made of ordinary glass can advantageously be used for the electrolysis.

The cathode can be made of a plate of aluminum, copper, lead or other metal generally used for cathodes. In actual practice, however, use of an aluminum plate anode proves particularly desirable from the standpoint of prevention of the produced aluminum from adulteration by other metals.

The purity of the aluminum educed on the cathode by electrolysis is affected by the bath composition. If the bath happens to contain compounds of iron, silicon, copper, etc., for example, these elements are educed from the bath before aluminum because they have lower decomposition voltages than aluminum.

When the anode and cathode are parallelly opposed to each other across a gap, the opposition may be either in the vertical direction or in the horizontal direction. With due consideration to the need for splitting off the educed aluminum, however, the horizontal direction is more advantageous than in the vertical direction.

Passage of an electric current between the cathode and anode disposed as described above in the electrolytic cell causes electrolysis of the electrolytic bath, with the result that aluminum is educed on the cathode and chlorine generated at the anode.

The mass of aluminum educed on the cathode gradually gains in size and grows in the shape of dendrites. When the growth reaches a depth of about 4 mm, for example, the aluminum in the shape of dendrites extends enough to form a short-circuit with the anode, although the deposited aluminum may at times fall spontaneously off the cathode. The educed aluminum has heretofore been obtained by repeating the steps of discontinuing the electrolysis, then stripping the aluminum off the cathode surface, supplying an additional bath, if necessary, and electrolyzing the total bath. That is to say, the conventional process has produced aluminum immediately after stripping the educed aluminum off the cathode surface and has caused the educed aluminum neither to fall to the bottom of the bath nor to be suspended in the bath. In the conventional process, therefore, there is no concept of causing the educed aluminum to be precipitated to the bottom of the electrolytic cell, collecting the precipitate and obtaining metallic aluminum from the precipitate and it has been assumed that application of such a concept would certainly end in failure.

The present inventor has exploded this well established misconception in the field of chemical knowledge and accomplished this invention.

The aluminum educed on the cathode is not immediately obtained as the product, but is caused to be split from the cathode and mixed in the bath. Since the split-off aluminum has a greater density than the bath, it precipitates to the bottom of the electrolytic cell if left as it is. While precipitating to the bottom of the cell the educt comes to include constituents of the bath, aluminum oxide resulting from the reaction involving the water present in the bath etc., to give rise to a muddy substance. The muddy substance usually contains therein from 30% to 60% by weight of aluminum and sometimes turns into a spongy mass. The separation of the muddy substance from the bath can easily be carried out by utilizing the difference in density therebetween.

Aluminum can continuously be obtained at high yields by constantly circulating the electrolyte by the outflow from and the inflow into the cell to impart mechanical shocks to the aluminum educed on the cathode, with the result that the educed aluminum is easily split from the cathode. The split-off aluminum forms the muddy substance as described above and is circulated together with the electrolyte. The muddy substance can be recovered as filter residue by disposing on the circulation path filter means such as a fabric made of glass fiber. Separation of aluminum from the filter residue can be carried out by melting the muddy substance into an aluminum phase and a fusion slag phase composed of the other components and isolating the former phase from the latter. The aluminum thus isolated has a purity in the range of from 99.0% to 99.9%. If the electrolytic bath in use is of a type free from the compounds of iron, silicon, copper, etc., the purity of the isolated aluminum can be raised to more than 99.8%.

The melting of this muddy deposit is accomplished by a method using flux or a method resorting to application of heat. The former method comprises the steps of mixing the educt into sodium chloride, potassium chloride or a fluoride retained in a fused state and consequently giving rise to a molten flux phase and an aluminum phase and subsequently isolating the aluminum phase from the other phase. The latter method comprises heating and melting the educt in an autoclave to give birth to a fused aluminum phase and a slag phase and isolating aluminum. By either of these methods, there is obtained aluminum having a purity exceeding 99.3% by weight.

This invention also embraces the outcome of an additional study made in search of a method capable of preventing said growth of the aluminum educed on the cathode in the shape of dendrites. The outcome of this study is the discovery that the growth of the educed aluminum can be curbed effectively without bringing about any adverse effect on the purity of educed aluminum when the electrolytic bath in use incorporates therein from 0.1% to 3% by weight of a magnesium or calcium salt having a higher decomposition voltage than aluminum.

Preferable magnesium salt and calcium salt for the purpose are magnesium chloride and calcium chloride. This is because carbonates, sulfates and other salts of magnesium and calcium react with the aluminum educed in the shape of dendrites and oxidize them to the extent of significantly degrading the electrolytic efficiency, whereas magnesium chloride or calcium chloride incorporated in said small proportion brings about no adverse effect but to the contrary has the favorable effect of slightly lowering the bath's melting point.

With the progress of electrolysis, the concentration of the electrolytic bath gradually changes and the aluminum chloride content in the bath decreases. By gradual replenishment of aluminum chloride, however, the continuous operation of the present process can be ensured.

The electric energy which is required for melting the muddy substance separated from the bath and composed preponderantly of aluminum is about 540 KWH per ton. Heavy oil or some other inexpensive thermal energy may be used for the fusion of the muddy substance.

In short, the present invention, in the electrolysis of aluminum chloride, does not contemplate directly obtaining as its final product the aluminum educed on the cathode but aims to offer as the final product the aluminum obtained by causing the educed aluminum to be isolated from the cathode in the electrolytic cell and subsequently meltling the isolated aluminum. The improved process enables the low-temperature electrolysis to be carried out at a high current density, rendering the operation commercially feasible.

Now, the present invention will be described with reference to working examples.

EXAMPLE 1

(Electrolytic cell)—In a constant temperature bath filled with silicone oil and provided with an agitation device, there was disposed an electrolytic system such as that illustrated in FIG. 1.

In the drawing, 1 denotes a glass beaker 500 cc in inner volume; 2 an aluminum plate cathode 1 mm in thickness, 30 mm in width and 60 mm in length, with one surface thereof coated with Teflon for the purpose of insulation; 3 an anode formed of three silicon carbide rods 7.4 mm in diameter and 150 mm in length; 4 an electrolytic bath weighing 330 g and composed of 76.3% by weight of $AlCl_3$, 9.2% by weight of KCl and 14.5% by weight of NaCl; 5 a mercury thermometer; 6 an ammeter; 7 a voltmeter; 8 a rectifier; and 9 a diaphragm made of glass fiber.

Denoted by 10 is a spongy mass of aluminum (a muddy substance) formed by the electrolysis and subsequently precipitated to the bottom of the electrolytic cell.

(Temperature of electrolytic bath)—The electrolytic bath was maintained at 150° C.

The constant temperature bath was maintained at 134° C., because internal heating occurred during the electrolysis to elevate the temperature of the constant temperature bath by 16° C.

(Current density)—The electric current was passed at a fixed amperage of 15 A.

Since the area of immersion of the cathode in electrolytic bath was 3 cm×5 cm, the current density for the cathode was 100 A/dm$^2$. The anode was immersed to a depth of 5 cm in the electrolytic bath. Thus, the area of immersion was $0.74\pi\times5\times3$ cm$^2$ and the current density for the anode was 43 A/dm$^2$.

The gap between the cathode and anode was fixed at 10 mm. In this case, the voltage was 8.2 V to 9.5 V.

(Results)—The electrolysis was carried out for three hours. At intervals of 10 minutes during the electrolysis, the spongy deposit of aluminum educed on the aluminum plate cathode was scratched off with a glass rod and allowed to settle to the bottom of the electrolytic cell.

At the anode, chlorine gas having a purity of about 70% was produced.

At the end of the electrolysis, the beaker was tilted to decant most of the electrolytic bath. The spongy deposit of aluminum remaining at the bottom was separated. It weighed 27 g and was found by analysis to be composed of 45% by weight of aluminum and the balance mostly of the electrolytic bath. In appearance, this was a gray sludge-like substance. This mixture was thrown into a flux which was a molten composition made up of 45% of sodium chloride, 45% of potassium chloride and 10% of sodium fluoride. In the flux, the mixture was fused to separate off an aluminum phase. By isolating and cooling this aluminum phase, granular aluminum was obtained. Thus was produced 12.15 g of aluminum having a purity of 99.3%. Since the theoretical amount of electricity required for electrolytic separation of 1 g of aluminum is 2.98 Ah, the current efficiency in the present example is calculated to be 80.5%.

EXAMPLE 2

In an electrolytic system of the construction illustrated in FIG. 1, an aluminum plate 10 mm in thickness, 30 mm in width and 60 mm in length was used as a cathode. In this system, electrolysis was carried out under the conditions identical to those of Example 1. The educed aluminum was processed in entirely the same manner.

The current density for the cathode was 100 A/dm$^2$, the current density for the anode was 100 A/dm$^2$, the bath temperature was 150° C. and the bath voltage was 2.7 V.

The electrolysis produced 12.75 g of granular aluminum having a purity of 99.9%, with the current efficiency at 84.4%.

In this electrolysis, the chlorine generated at the anode reacted with the aluminum of the cathode to produce aluminum chloride and pass into the electrolytic bath. Thus, no chlorine gas left the system.

EXAMPLE 3

Figure 2:
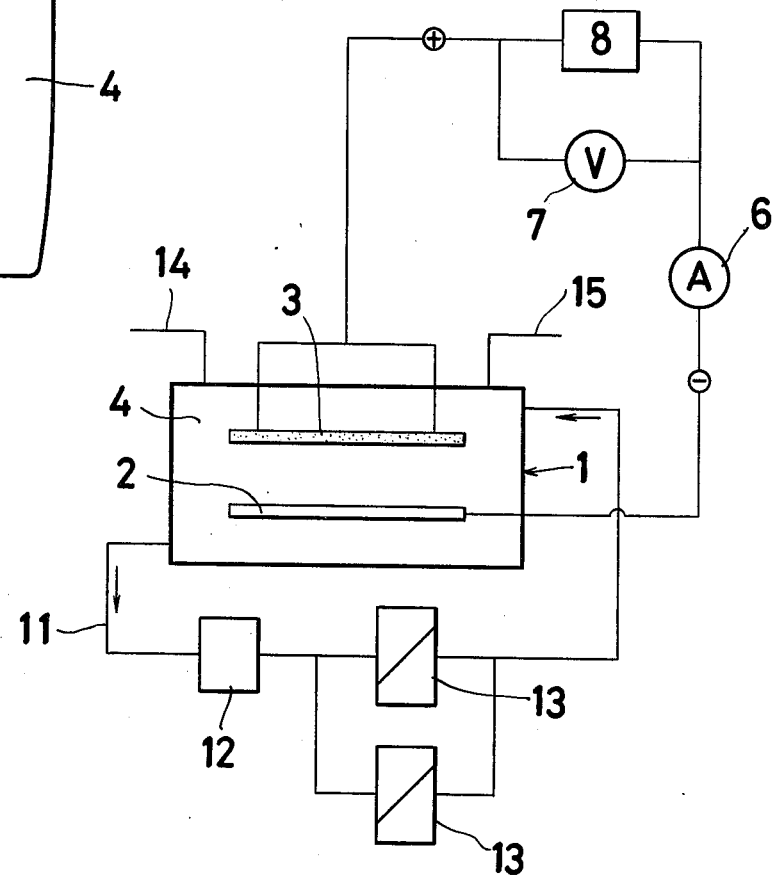
FIG. 2 is a schematic diagram illustrating an apparatus used in Example 3.

An electrolytic system of the construction illustrated in FIG. 2 was used.

In the drawing, 1 denotes an electrolytic cell 5 cm in width, 11 cm in length, 10 cm in height and 550 cm$^3$ in capacity; 2 an aluminum plate cathode 0.2 cm in thickness, 8 cm in width and 15 cm in length, with one surface thereof coated with Teflon for the purpose of insulation, said aluminum plate being immersed lengthwise into an electrolytic bath by 5 cm to form a cathodic surface area of 40 cm$^2$; 3 a tungsten plate anode having a purity of 99%, 0.03 cm in thickness, 8 cm in width and 15 cm in length, with one surface thereof coated with Teflon for the purpose of insulation, said tungsten plate being immersed lengthwise into the bath by 5 cm to form an anodic surface area of 40 cm$^2$; 4 electrolyte composed of 76.3% by weight of $AlCl_3$, 9.2% by weight of KCl and 14.5% by weight of NaCl; 6 an ammeter; 7 a voltmeter; and 8 a rectifier.

Denoted by 11 is a pipe for circulating the electrolyte, 12 a circulation pump, 13 a filter, 14 a pipe for discharging the gas generated and 15 a pipe for supplying the constituents of the electrolyte into the cell.

Electrolysis was carried out under the following conditions by use of the apparatus shown in FIG. 2.

The electric current was passed at a fixed amperage of 40 A. The voltage as 6.1 V to 6.3 V. The electrolytic cell was maintained at 180° C. The electrolyte was circulated for one minute every five minutes at a rate of 2 l per minute. The two filters were used alternately every 60 minutes. As a result, there was obtained a muddy substance from the filters in an amount of 27 g per hour. 22.7 l per hour (N.T.P.) of chlorine was discharged from the pipe 14, and 66 g per hour of aluminum chloride was continuously supplied from the pipe 15 into the electrolytic cell. The muddy substance thus obtained contained about 45% by weight of aluminum, with the balance consisting of the constituents of the electrolytic bath.

The muddy substance was thrown into a graphite crucible containing therein molten flux (composed of 45% of sodium chloride, 45% of potassium chloride and 10% of sodium fluoride) to obtain a molten substance. An aluminum phase formed in the molten substance was separated by difference in specific gravity and then cooled. The electrolysis produced 12.22 g of granular aluminum having a purity of 99.8%, with the current efficiency at 91%.

Further, the tungsten plate anode used in this Example underwent no change during the 200-hour operation, and tungsten was not present either in the muddy substance or in the electrolyte.

What is claimed is:

1. A process for the production of aluminum by low-temperature electrolysis of aluminum chloride, which process comprises: a first step of:

electrolyzing in an electrolytic cell an electrolytic bath containing not less than 50% by weight of aluminum chloride, from 0 to 30% by weight of potassium chloride and from 10 to 40% by weight of sodium chloride while using as the anode one member selected from the group consisting of a tungsten plate, a silicon carbide plate and an aluminum plate and causing the current density for the anode to fall in the range of from 0.5 A/dm$^2$ to 200 A/dm$^2$, the current density for the cathode to fall in the range of from 0.5 A/dm$^2$ to 200 A/dm$^2$, the bath temperature to fall in the range of from 120° C. to 250° C. and cell voltage in the range of from 2.7 V to 11.4 V and, at the same time, circulating the bath by causing it to flow out of the electrolytic cell, then to pass through a filter to thereby separate filter residue therefrom and subsequently to flow into the cell, so as to educe aluminum on the cathode by the electrolysis and cause the educed aluminum to be split from the cathode by the shocks of the outflow of the bath from and the inflow of the bath into the cell and to form in the bath a muddy substance to be filtered by the filter and collected as filter residue in the circulation of the bath; and a second step of melting the collected filter residue to give rise to an aluminum phase and a fusion flag phase and isolating the aluminum phase.

2. The process according to claim 1, wherein the electrolytic bath is composed of not less than 50% and not more than 93% by weight of aluminum chloride.

3. The process according to claim 2, wherein the electrolytic bath is composed of 10 to 40% by weight of sodium chloride, 0 to 35% by weight of potassium chloride and the balance to make up 100% of aluminum chloride.

4. The process according to claim 2, wherein the electrolytic bath is composed of 60 to 87% by weight of aluminum chloride, 14 to 30% by weight of sodium chloride and 0 to 10% by weight of potassium chloride.

5. The process according to claim 1, wherein the anode is made of metallic aluminum having a purity of not less than 99%.

6. The process of claim 1, wherein said anode is a tungsten plate.

7. The process of claim 1, wherein said anode is a silicon carbide plate.

* * * * *

UNITED STATES PATENT AND TRADEMARK OFFICE

CERTIFICATE OF CORRECTION

PATENT NO. : 4,159,928

DATED : July 3, 1979

INVENTOR(S) : YOSHISHIGE TSUMURA

It is certified that error appears in the above-identified patent and that said Letters Patent are hereby corrected as shown below:

Please insert the following priority information:

[30] -- May 26, 1976 [JP] Japan ... 51/59953 --

Signed and Sealed this

*Eighth* Day of *January 1980*

[SEAL]

*Attest:*

SIDNEY A. DIAMOND

*Attesting Officer*

*Commissioner of Patents and Trademarks*